US007618264B2

(12) United States Patent
Wu

(10) Patent No.: US 7,618,264 B2
(45) Date of Patent: Nov. 17, 2009

(54) ELECTRICAL CONNECTOR WITH DUAL-INTERFACE

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 39 days.

(21) Appl. No.: 12/080,328

(22) Filed: Apr. 1, 2008

(65) Prior Publication Data

US 2009/0247017 A1 Oct. 1, 2009

(51) Int. Cl.
*H01R 12/00* (2006.01)

(52) U.S. Cl. ..... 439/76.1

(58) Field of Classification Search ..... 439/76.1, 439/493, 77, 607.46–607.49, 607.41, 604.56
See application file for complete search history.

(56) References Cited

U.S. PATENT DOCUMENTS 3,500,267 A * 3/1970 Wasserman ..... 335/112
5,219,294 A 6/1993 Marsh et al.
6,739,910 B1 5/2004 Wu
6,848,943 B2 * 2/2005 Machado et al. ..... 439/607.01
7,134,914 B1 11/2006 Wu

OTHER PUBLICATIONS

"PCI Express External Cabling Specification, Version 1.0" published on Dec. 6, 2005 by PCI-SIG.

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical connector assembly (100) includes a housing (10) including a first shield part (1) assembled to a second shield part (2) to form a receiving space, said receiving space consisting of a hollow portion (110) and a mating port (120) located in front of the hollow portion; a pair of first and second printed circuit boards (3*a*, 3*b*) received in the receiving space, both the pair of printed circuit boards having mating interfaces extending into the mating port (120) and mounting portions located within the hollow portion (110); and a spacer (4) interposed between the pair of first and second printed circuit boards, said spacer cooperating the housing to fix the pair printed circuit boards within the receiving space.

16 Claims, 5 Drawing Sheets

ELECTRICAL CONNECTOR WITH DUAL-INTERFACE

FIELD OF THE INVENTION

The present invention generally relates to an electrical connector, and more particularly to an electrical connector having double interfaces for high-speed signal transmission.

DESCRIPTION OF PRIOR ART

PCI Express, officially abbreviated as PCI-E or PCIe, is a computer expansion card interface format introduced by Intel in 2004. It was designed to replace the general-purpose PCI expansion bus, the high-end PCI-X bus and the AGP graphics card interface. Unlike previous PC expansion interfaces, rather than being a bus it is structured around point-to-point full duplex serial links called lanes. In PCIe 1.1 (the most common version as of 2007) each lane carries 250 MB/s in each direction.

PCI Express External Cabling which extends the PCI Express interconnect architecture "outside the box." Cables using the PCIe technology will be used for external applications, as well as applications internal to an enclosure that need a cable connection. PCI Express External Cabling Specification, REV 1.0 introduced four kinds of cable assemblies x1, x4, x8 and x16, and among which the x16 cable assembly may reach highest transmitting rate. However, the Cabling Specification only proposes some basic interface issue of a cable connector, lacking of detailed illustration upon a utility and practical cable connector, especially printed circuit boards arrangement within a hollow portion of a housing.

Hence, an improved cable connector is highly desired to overcome the aforementioned problems.

SUMMARY OF THE INVENTION

Accordingly, an object of the present invention is to provide an electrical connector having stacked printed circuit boards as mating interfaces.

In order to achieve the object set forth, an electrical connector in accordance with the present invention comprises a housing including a first shield part assembled to a second shield part to form a receiving space, said receiving space including a hollow portion and a mating port located in front of the hollow portion; a pair of first and second printed circuit boards received in the receiving space, both the pair of printed circuit boards having mating interfaces extending into the mating port and mounting portions located within the hollow portion; and a spacer interposed between the pair of first and second printed circuit boards, said spacer cooperating the housing to fix the pair printed circuit boards within the hollow portion.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
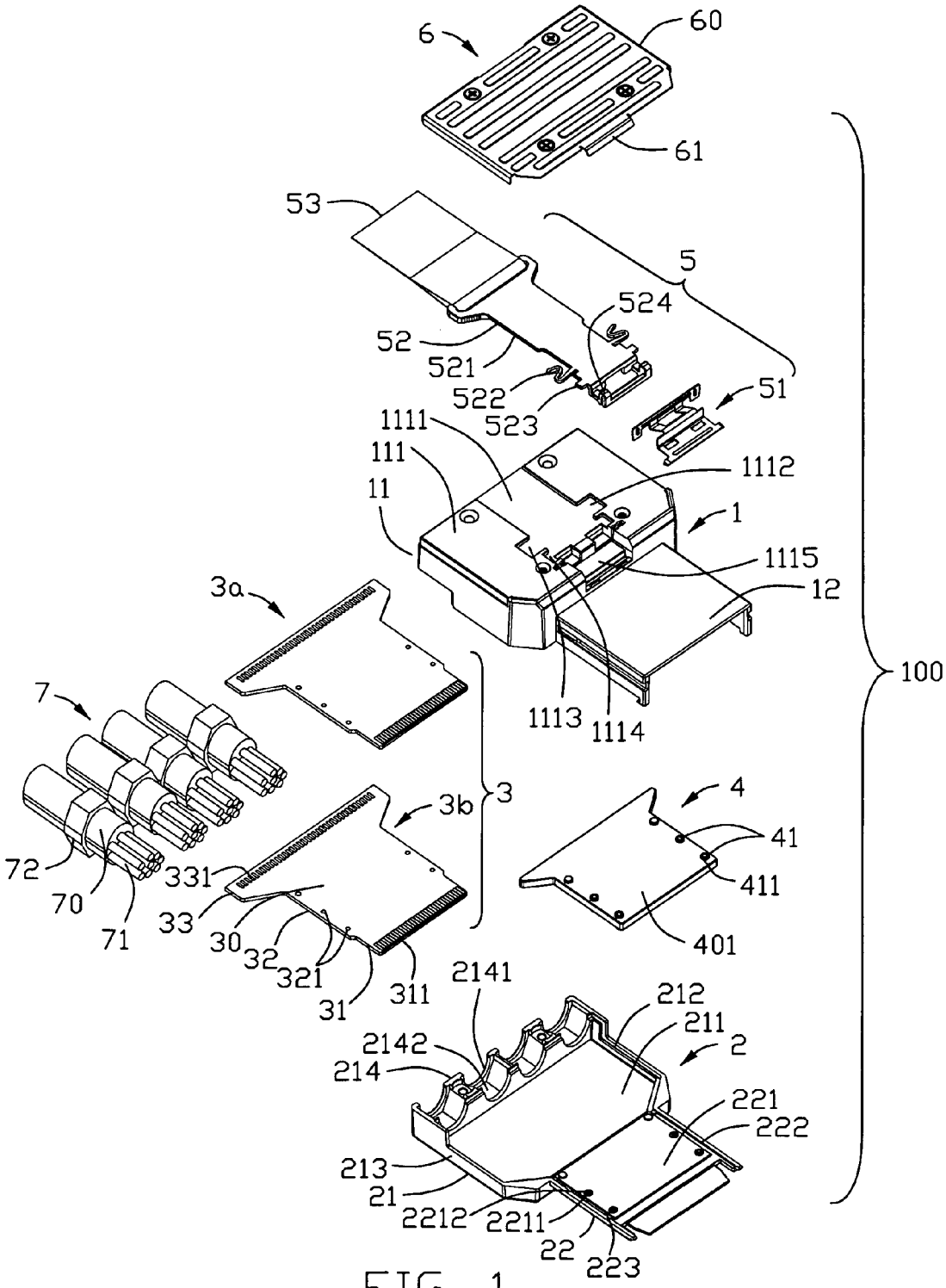
FIG. 1 is an exploded, perspective view of a cable connector in accordance with the present invention.
Figure 2:
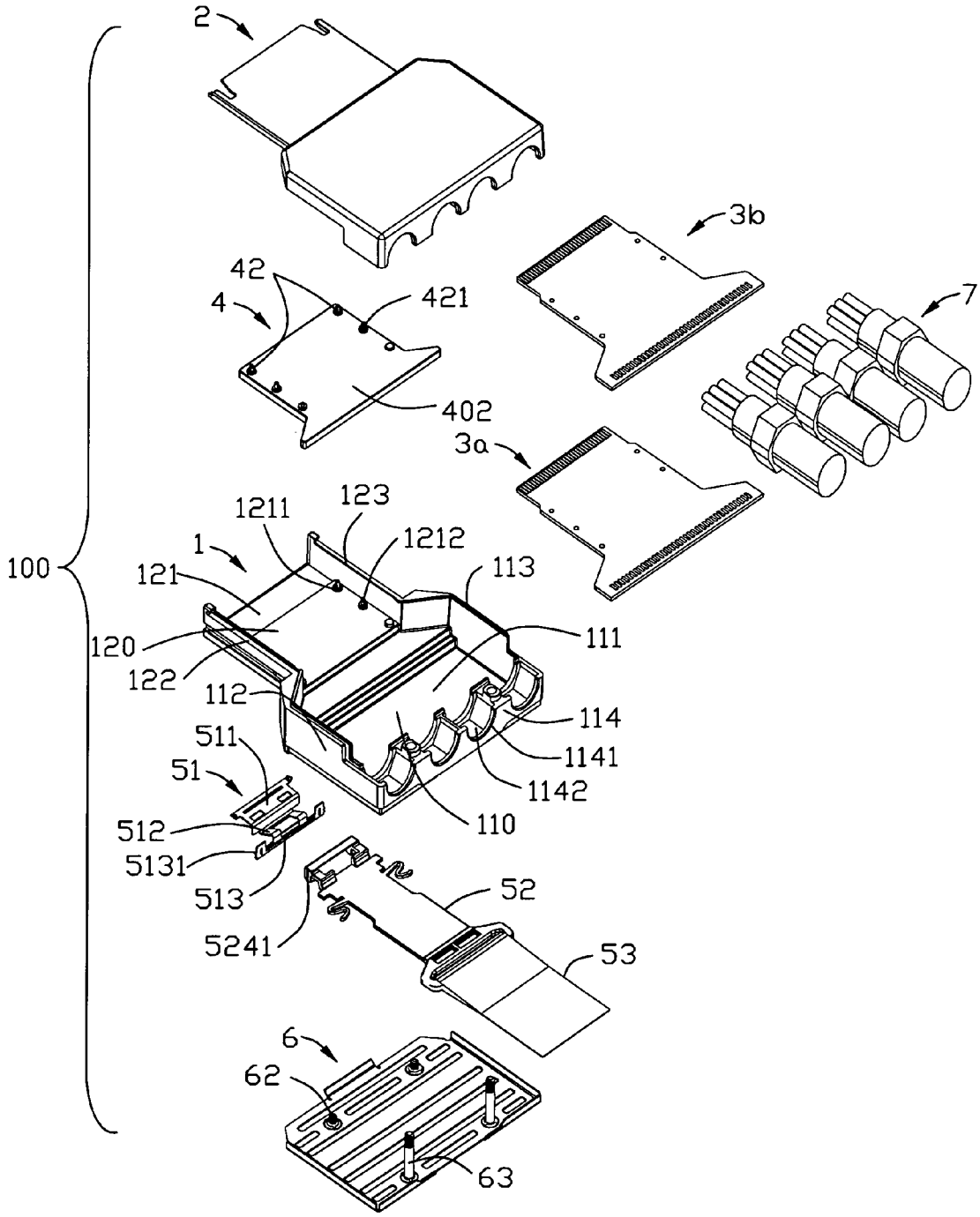
FIG. 2 is similar to FIG. 1, but viewed from another aspect.
Figure 3:
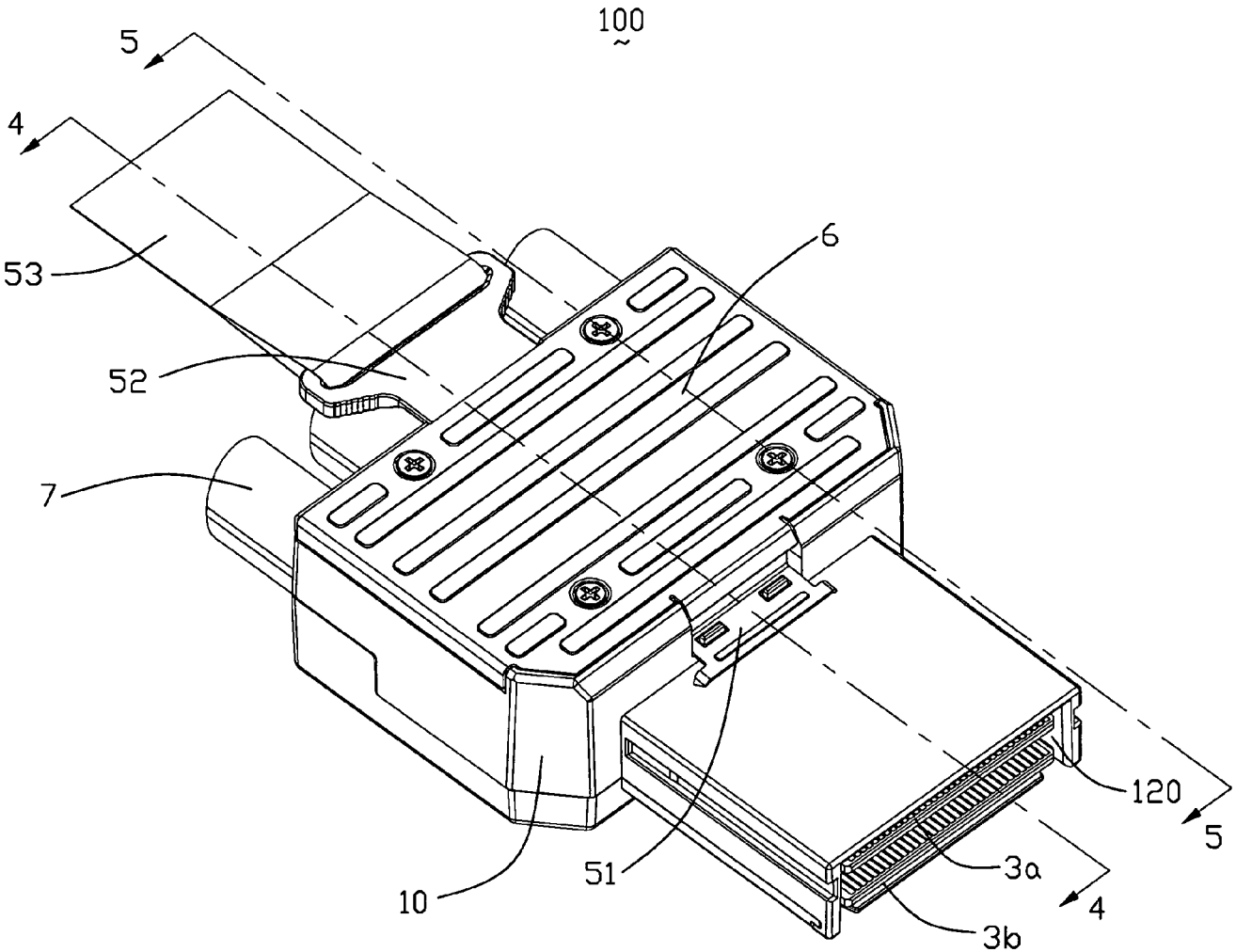
FIG. 3 is an assembled, perspective view of the cable connector.
Figure 4:
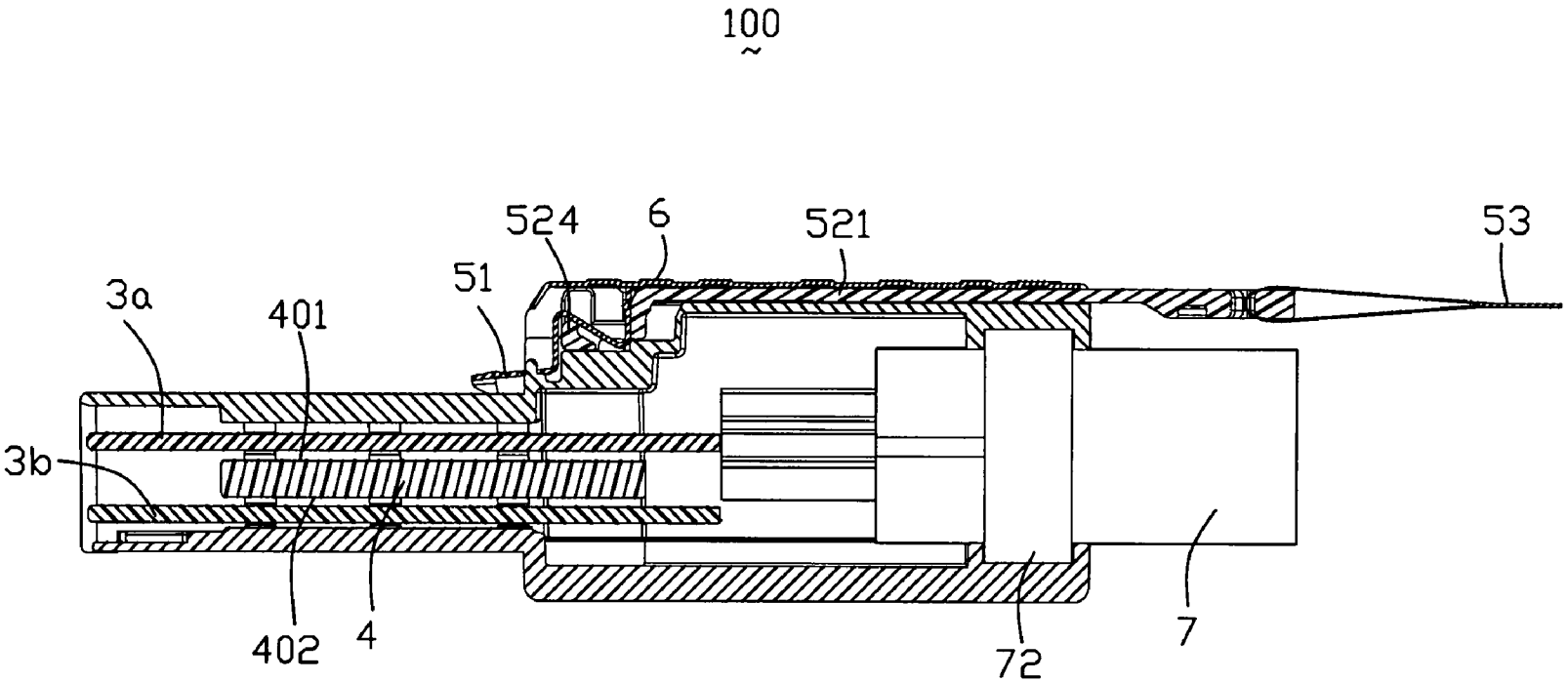
FIG. 4 is a cross-section view of FIG. 3 taken along line 4-4.
Figure 5:
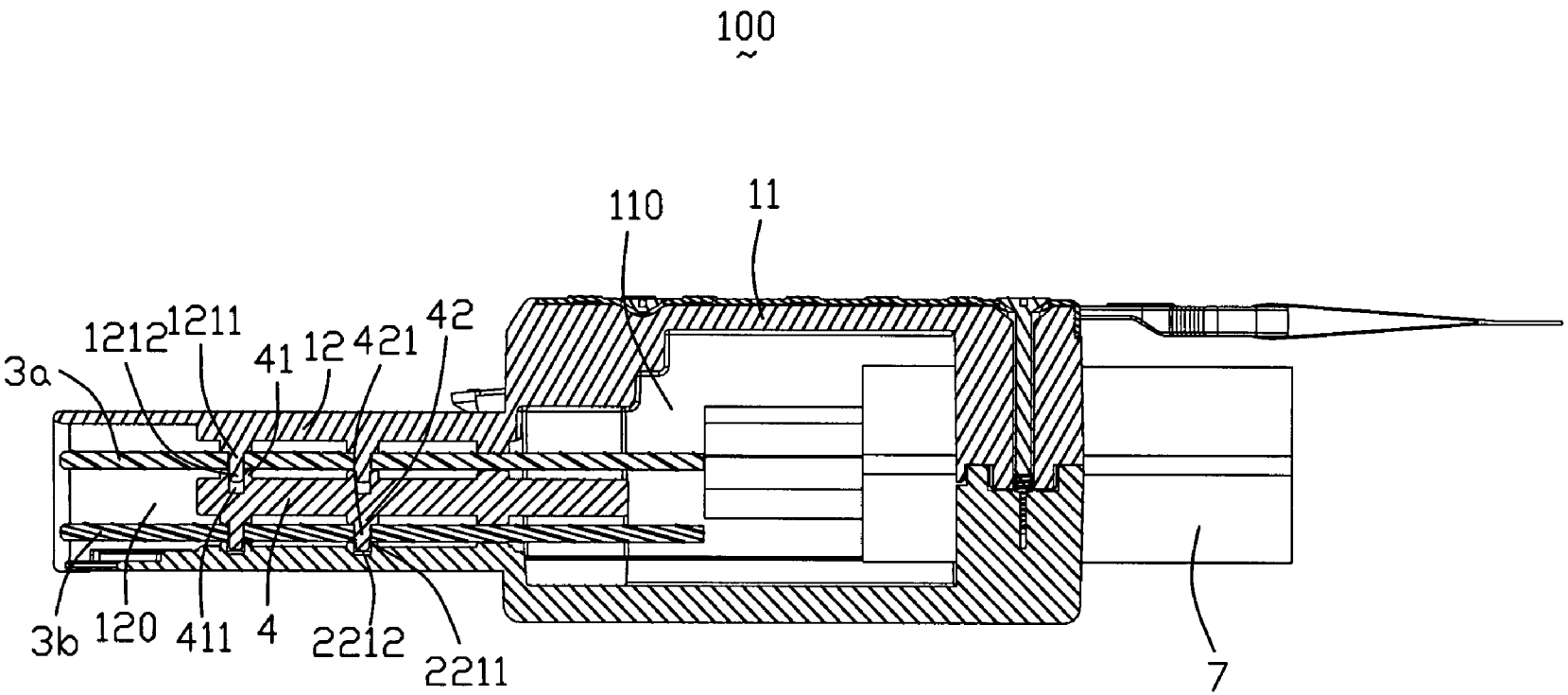
FIG. 5 is a cross-section view of FIG. 3 taken along line 5-5.

Referring to FIGS. 1-5, an electrical connector 100 in accordance with the present invention comprises a housing 10 defining a receiving space (not numbered) therein, a pair of printed circuit boards (PCBs) 3 received in the hollow portion, a spacer 4 interposed between the pair of the printed circuit boards 3.

The housing 10 includes a first shield part 1 and a second shield part 2 associated together to define the receiving space. The first shield part 1 comprises an expanded first base portion 11 and a relative slim first mating portion 12 extending forwardly from a front edge of the first base portion 11. The first base portion 11 has a top wall 111, a pair of side walls 112, 113 and a rear wall 114 cooperating a hollow portion 110. Four semi-circular outlets 1141 are defined in the rear wall 114 and arranged in a row along transversal direction. Four cavities 1142 are respectively recessed in the outlets 1141 along radial direction. The first mating portion 12 has a top side 121, a pair of transversal sides 122, 123 cooperating a mating port 120 located in front of and communicating with the hollow portion 110. Two pair of position posts 1211 are separated from each other and arranged at lateral sides of the top side 121 and each of them further has a tiny stub 1212 formed thereon.

The upper portion of the top wall 111 defines a first channel portion 1111 arranged in a middle section thereof and a deeper second channel portion 1114 in front of and communicating with the first channel portion 1111. A pair of first grooves 1112 are located in the middle section of the top wall 111 and further communicates with the first channel portion 1111. Two second grooves 1113 are in front of the first grooves 1112 and also communicates with the first channel portion 1111. A pair of slots 1115 are recessed downwardly from a top surface of a front section of the top wall 111 and communicates with the second channel portion 1114.

The second shield part 2 comprises a second base portion 21 and a second mating portion 22 extending forwardly from a front edge of the second base portion 21. The second base portion 21 has a bottom wall 211, a pair of side walls 212, 213 and a rear wall 214 extending upwardly from lateral edges and rear edge of the bottom wall 211. Four semi-circular outlets 2141 are defined in the rear wall 214 and arranged in a row along transversal direction. Four cavities 2142 are recessed in the outlets 2141 along radial direction. The first mating portion 22 has a bottom side 221, a pair of flanges 222, 223 formed at lateral edges of the bottom side 221. Two pair of support members 2211 are respectively arranged at lateral sides of the bottom side 221 and each of them further defines a hole 2212 therein.

The pair of PCBs 3 includes a first PCB 3*a* and a second PCB 3*b* both having identical configuration. The second PCB 3*b* has a substrate 30 which includes a middle portion 32, a narrower front portion 31 and a broader rear portion 33. A group of first conductive pads 311 arranged on the front portion 31 to form a mating interface and a set of second conductive pads 331 arranged on the rear portion 33 of the substrate 30 to from a mounting portion for connecting at least one cable 7. A distance between two adjacent first conductive pads 331 is narrower than a distance between two adjacent second conductive pads 311. Two pair of through holes 321 respectively defined in lateral sides of the middle portion 32 of the substrate 30.

The spacer 4 defines an upper surface 401 and an opposite lower surface 402. Two pair of first protrusion members 41 extend upwardly from the upper surface 401 of the spacer 4 and each has a cavity 411 therein. Another pair of second protrusion members 42 extend downwardly from the lower surface 402 of the spacer 4 either, and each second protrusion member 42 has a post 421 formed thereon.

Each cable 7 includes a number of wires 71 and an insulated jacket 70 enclosing thereon. A holder member 72 is attached to a front portion of the cable 7 and arranged in the cavity 1142 of the rear walls 1141, 2141 to retain the cable 7 with the housing 1.

An optional latch mechanism 5 is assembled to the housing 10 of the cable connector 100. The latch mechanism 5 includes a latch member 51, an actuator 52 and a pull tape 53 tied to a rear portion of the actuator 52. The actuator 52 has a main body 521 received in the first channel portion 1111, a pair claw-shaped spring member 522 arranged at lateral sides of a front segment of the main body 521 and received in the first grooves 1112, a pair of stopper 523 disposed in front of the pair of claw-shaped spring member 522 and arranged at the lateral sides of the main body 521 and received in the second grooves 1113, an engaging portion 524 formed at a front end of the actuator 521 and received in the second channel portion 1114. The latch member 51 has a latch portion 511 disposed above first mating portion 12 of the housing 10, an engage segment 513 attached to the first base portion 11, with a pair of ear portions 5131 thereof interferentially received in the pair of slots 1115 of the first base portion 11, an N-shaped interconnecting portion 512 disposed above the engaging portion 524 of the actuator 52.

When assembly, the wires 71 of the cables 7 are soldered to the second conductive pads 331 of PCBs 3, then the first PCB 3*a* is assembled to the first shield part 1 and supported by the pair of position posts 1211, with the tiny stubs 1212 penetrate the two pair of through holes 321 of the first PCB 3*a*, the mating interface extending into the mating port 120 and the rear portion 33 located in the hollow portion 110. Secondly, the spacer 4 is laid on the first PCB 3*a*, with distal parts of the tiny stubs 1212 inserted into cavities 411 of the first protrusion members 41 thereof. Thirdly, the second PCB 3*b* is laid on the spacer 4 and supported by second protrusion members 42 thereof, with the tiny posts 421 of the protrusion members 42 passing the pair of through holes 321. Fourthly, the second shield part 2 is assembled to the first shield part 1, with the support members 2211 thereof pressed onto the PCB 3*b* and the tiny posts 421 of the spacer 4 inserted into holes 2212 of the support members 2211. Fifthly, the latch mechanism 5 is assembled to the first shield part 1. Sixthly, a cap member 6 is assembled to the first shield part 1 to fix the latch mechanism 5, with a main portion 60 of the cap member 6 shielding the first base portion 11, a spring member 61 formed at a front edge thereof pressing onto the latch portion 511. A pair of first bolts 62 and a pair of second bolts 63 are assembled to the first and second shield parts 1, 2 to combine them together with the cap member 6. It is obvious that the printed circuit boards 3 is assembled to the housing 10 easily by the spacer 4, and retention/retain means, such as position posts 1211, first protrusion members 41, etc. that applied to fix the printed circuit boards 3 to housing 10 is not limited to the structure as described in the embodiment, another alternative structure is also available.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector, comprising a housing including a first shield part assembled to a second shield part to form a receiving space, said receiving space including a hollow portion and a mating port located in front of the hollow portion;

a pair of first and second printed circuit boards received in the receiving space, both the pair of printed circuit boards having mating interfaces extending into the mating port and mounting portions located within the hollow portion; and a spacer interposed between the pair of first and second printed circuit boards, said spacer cooperating the housing to fix the pair printed circuit boards within the receiving space, wherein a support member formed on the second shield part supports the printed circuit board, and the spacer has at least one protrusion member contacting the printed circuit board, wherein a post is formed on the protrusion member extending through the printed circuit board and inserted into a hole in the support member, wherein at least another protrusion member formed on an opposite side of the spacer to support another printed circuit board, and the first shield part has a position post contacting the printed circuit board, wherein a stub is formed on the position post extending through said printed circuit board and inserted into a cavity in the another protrusion member.

2. The electrical connector as recited in claim 1, wherein the spacer and the pair of the printed circuit boards are separated from and parallel to each other.

3. The electrical connector as recited in claim 2, wherein both the pair of printed circuit boards have identical structure.

4. The electrical connector as recited in claim 3, wherein the pair of printed circuit boards align with one another along a vertical direction.

5. The electrical connector as recited in claim 4, wherein each of the pair of printed circuit boards has a rear segment and a front segment, said front segment narrower than the rear segment.

6. The electrical connector as recited in claim 5, wherein a group of first conductive pads arranged on the front segment to form the mating interface, and wherein a set of second conductive pads arranged on the rear segment to form the mounting segment.

7. The electrical connector as recited in claim 6, wherein a distance between two adjacent first conductive pads is narrower than a distance between two adjacent second conductive pads.

8. The electrical connector as recited in claim 5, wherein the hollow portion is larger than the mating port.

9. The electrical connector as recited in claim 1, wherein a rear wall of the housing defines a number of outlets to allow cables exiting outward through therein.

10. The electrical connector as recited in claim 9, wherein a number of cavities located in the outlets are recessed along radial direction, respectively.

11. An electrical connector assembly, comprising:

a housing enclosing a receiving space, said receiving space including a hollow portion and a mating port located in front of the hollow portion and the housing including a first shield part assembled to a second shield part to form the receiving space;

a pair of first and second printed circuit boards received in the receiving space, both the pair of printed circuit boards having mating interfaces extending into the mating port and mounting portions located within the hollow portion;

a spacer interposed between the pair of first and second printed circuit boards, said spacer cooperating the housing to fix the pair printed circuit boards within the receiving space; and at least a pair of cables coupled to mounting portions of the pair of printed circuit boards, respectively, wherein a support member formed on the second shield part supports the printed circuit board, and the spacer has at least one protrusion member contacting the printed circuit board, wherein a post is formed on the protrusion member extending through the printed circuit board and inserted into a hole in the support member, wherein at least another protrusion member formed on an opposite side of the spacer to support another printed circuit board, and the first shield part has a position post contacting the printed circuit board, wherein a stub is formed on the position post extending through said printed circuit board and inserted into a cavity in the another protrusion member.

12. The electrical connector assembly as recited in claim 11, wherein retention means of the spacer is applied to fix the second printed circuit board to the housing.

13. The electrical connector assembly as recited in claim 12, wherein retaining means of the housing is applied to fix the first printed circuit board to the spacer.

14. The electrical connector assembly as recited in claim 13, wherein the pair of printed circuit board are arranged at different levels.

15. The electrical connector assembly as recited in claim 14, wherein the pair of printed circuit boards are adjacent to the spacer, rather than contact an upper and lower surfaces thereof.

16. The electrical connector assembly as recited in claim 11, wherein a holder member are attached to a front segment of the cable and retained in corresponding cavity defined in a rear wall of the housing.

* * * * *